US006789964B2

(12) United States Patent
Kawaguchi

(10) Patent No.: US 6,789,964 B2
(45) Date of Patent: Sep. 14, 2004

(54) WIRE DOT PRINTER HEAD

(75) Inventor: Takahiro Kawaguchi, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 29 days.

(21) Appl. No.: 10/098,572

(22) Filed: Mar. 18, 2002

(65) Prior Publication Data

US 2003/0175064 A1 Sep. 18, 2003

(51) Int. Cl.[7] ..... B41J 2/275
(52) U.S. Cl. ..... 400/124.22
(58) Field of Search ..... 400/124.22, 124.23

(56) References Cited

U.S. PATENT DOCUMENTS 4,552,064 A * 11/1985 Sanders, Jr. et al. ..... 101/93.05

FOREIGN PATENT DOCUMENTS

| | | | | |
|---|---|---|---|---|
| JP | 04158050 A | * | 6/1992 | ..... B41J/2/235 |
| JP | 5-238019 | | 9/1993 | |
| JP | 06024014 A | * | 2/1994 | ..... B41J/2/28 |
| JP | 06286169 A | * | 10/1994 | ..... B41J/2/28 |
| JP | 07309022 A | * | 11/1995 | ..... B41J/2/275 |
| JP | 2001-30523 | | 2/2001 | |

OTHER PUBLICATIONS

Machine translation of JP 06286169 from Japanese Patent Office website.*
Machine translation of JP 07309022 A to Suga et al. from Japanese Patent Office website.*
Machine translation of JP 06024014 A to Kuriyama et al. from Japanese Patent Office website.*

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

In a wire dot printer of the present invention, an armature stopper against which an armature rocking from a printing position to a standby position collides is provided, and the armature stopper is formed by integrating an elastic plate and a hard plate with each other. The hard plate is made of surface-hardened titanium having excellent abrasion resistance. As the hard plate is made of surface-hardened titanium having excellent abrasion resistance, even when the armature rocking to the standby position collides against the armature stopper, the hard plate is not scraped, broken or deformed. As the elastic plate and the hard plate are integrated with each other, a shock upon collision between the armature and the hard plate is efficiently absorbed by the elastic plate, and vibration of the hard plate due to the collision between the armature and the hard plate can be suppressed.

8 Claims, 4 Drawing Sheets

WIRE DOT PRINTER HEAD

BACKGROUND OF THE INVENTION

1. Field of the Invention

The present invention relates to a wire dot printer head of wire dot printer, and more particularly, to a wire dot printer head having an armature stopper for contact with an armature rocking from a printing position to a standby position.

2. Discussion of the Background

Conventionally known is a wire dot printer head, in which printing wire is coupled to an armature to rock between a printing position and a standby position. When the armature rocks to the printing position, an end of the wire is collided against a print sheet, thereby printing is performed.

This wire dot printer head has an armature stopper with which the armature comes into contact when it rocks from the printing position to the standby position. The armature stopper absorbs a shock upon rocking of the armature to the standby position, suppresses a rebound of the armature, and prevents occurrence of inconvenience such as overstriking or poor feeding of ribbon which is caught due to rebound. As an example of armature stopper, a structure where a rubber elastic sheet and a stainless plate are overlapped with each other is known. This armature stopper is provided in a direction where the armature rocked to the standby position comes into contact with the stainless plate.

However, in recent years, printing speed and printing pressure have been increased, and in accordance with such high printing speed and high printing pressure, an impact of collision between the armature stopper and the armature that rocked to the standby position has been increased.

As the impact of collision between the armature and the armature stopper increases, a part of the stainless plate to be collided against the armature as a part of the armature is cut away, broken or deformed. If the part to be collided against the armature wears, broken or deformed, printing stroke of the armature is changed, and variation occurs in printing timing and printing pressure in each wire, thus printing quality is degraded.

Further, if the shock of the collision between the armature and the armature stopper increases, the plate vibrates due to the shock, and the vibration of the plate is transmitted to other armatures. In the other armature to which the vibration is transmitted, variation occurs in rocking timing of the rocking with respect to the printing position and printing pressure, thus printing quality is degraded.

SUMMARY OF THE INVENTION

Accordingly, an object of the present invention is to prevent the abrasion, breakage or deformation of the portion of the armature stopper to be in contact with the armature when the armature rocking from the printing position to the standby position comes into the armature stopper.

Another object of the present invention is to suppress vibration of the armature stopper when the armature rocking from the printing position to the standby position comes into contact with the armature stopper.

These objects of the present invention are attained by a novel wire dot printer of the present invention.

Accordingly, in the novel wire dot printer head of the present invention, an armature stopper with which an armature rocking from a printing position to a standby position comes into contact is formed by integrating an elastic plate and a hard plate with each other. The hard plate is made of material having high abrasion resistance for prevention of scrape, breakage or deformation even by collision by the armature rocking to the standby position.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, Wherein.

DETAILED DESCRIPTION OF THE PREFERRED EMBODIMENTS

Obviously, numerous modifications and variations of the present invention are possible in light of the above teachings. It is therefore to be understood that within the scope of the appended claims, the invention may be practiced otherwise than as specifically described herein.

Figure 1:
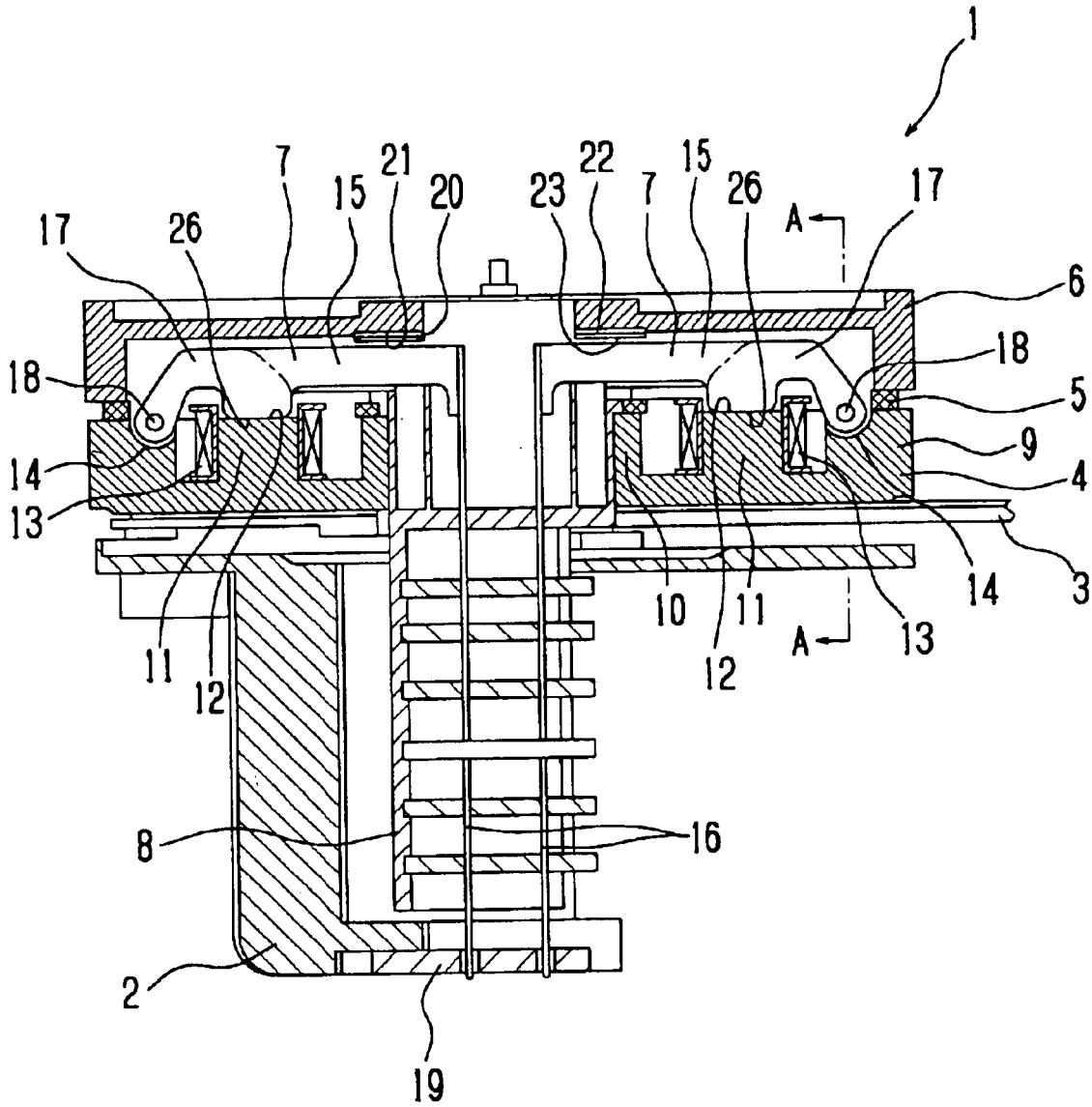
FIG. 1 is a central longitudinal cross-sectional front view of a wire dot printer head of the present invention.
Figure 2:
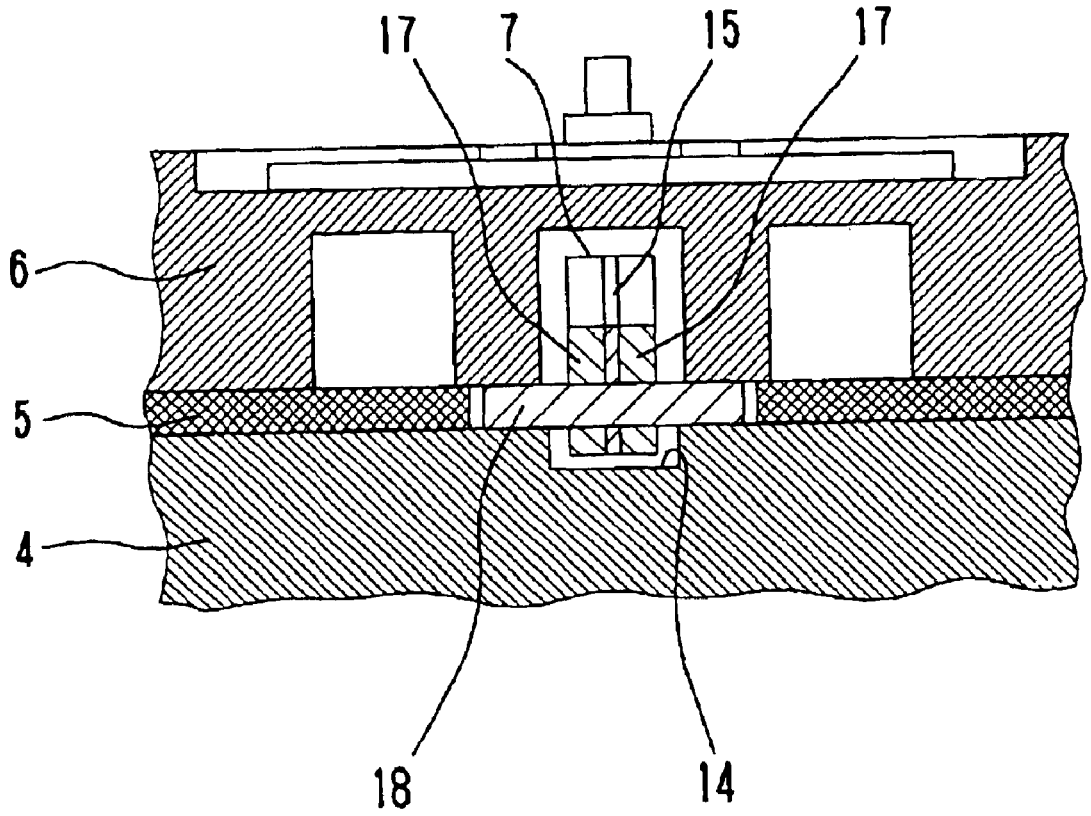
FIG. 2 is a partial longitudinal cross-sectional side view along a line A—A in FIG. 1 for explanation of armature support structure.

A first embodiment of the present invention will be described with reference to FIGS. 1 to 3.

First, the entire structure of a wire dot printer head 1 will be described with reference to FIG. 1. The wire dot printer head 1 is formed with a front case 2, a circuit board 3, a yoke 4, an armature spacer 5, a rear case 6, plural armatures 7, a wire guide 8 and the like. The front case 2 and the rear case 6 are connected to each other by attachment screws (not shown), and the circuit board 3, the yoke 4, the armature spacer 5, the armature 7 and the wire guide 8 are held between the front case 2 and the rear case 6. The plural armatures 7 are radially provided.

The yoke 4 is made of magnetic material. The yoke 4 has an outer cylindrical part 9 and an inner cylindrical part 10, and plural cores 11 are formed between the cylindrical part 9 and the cylindrical part 10. Each of these cores 11 has a magnetic pole surface 12 at an end in an axial direction. A coil 13 is attached around an outer periphery of each core 11. Plural cavities 14 corresponding to the cores 11 are formed in the outer cylindrical part 9 of the yoke 4. The number of the cores 11, that of the cavities 14 and that of the armatures 7 are the same. The respective armatures 7 are provided to be opposed to the respective cores 11 and the respective cavities 14.

The armature 7 is formed with an arm 15, a wire 16 wax-bonded to one end side of the arm 15 and a magnetic circuit formation member 17 welded to both side surfaces of the arm 15. The armature 7 is supported to be capable of rocking by a support shaft 18. The armature 7 is capable of rocking between a printing position and a standby position about the support shaft 18. When the armature 7 rocks between the printing position and the standby position, the wire 16 guided by the wire guide 8 slides. When the armature 7 rocks to the printing position, the end of the wire 16 collides against a print sheet and performs printing. An end guide 19 which arrays the end of the slidable wire 16 in a predetermined pattern and hold it is provided at an end of the front case 2.

The rocking of the armature 7 is made by intermittent energization to the coil 13, and when the coil 13 is energized, the armature rocks to the printing position about the support shaft 18. FIG. 1 shows a status where two armatures 7 both have rocked to the printing position. When energization to the coil 13 is stopped, the armature 7 rocks to the standby position by biasing force of biasing means (not shown).

A ring shaped armature stopper 20 is attached to the center of the rear case 6. The attachment of the armature stopper 20 to the rear case 6 is made by inserting the armature stopper 20 to an attachment recess part 21 formed in the rear case 6. The armature stopper 20 has a function of defining the standby position of the armature 7 by contact between the arm 15 as a part of the armature 7 with the armature stopper 20 when the armature 7 rocks from the printing position to the standby position.

Figure 4:
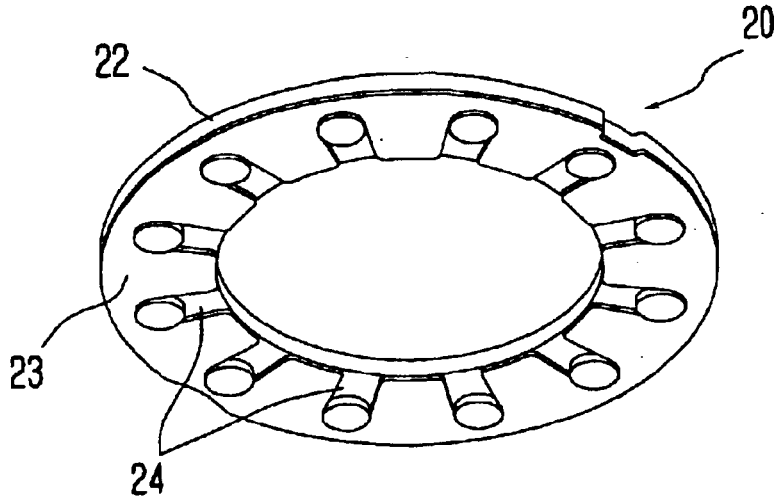
FIG. 4 is a perspective view of enlarged armature stopper.

As shown in FIG. 4, the armature stopper 20 is comprised of an elastic plate 22 of fluorine rubber and a hard plate 23 of surface-hardened titanium. The elastic plate 22 and the hard plate 23 are integrated with each other such that no gap occurs therebetween, and the integration is made by baking or by attachment using adhesive. The baking is made by placing the hard plate 23 in a mold and pouring melted fluorine rubber in the mold. Plural cutouts are formed radially in the hard plate 23 to catch parts of the elastic plate 22. As the parts of the elastic plate 22 are caught in the cutouts 24 of the hard plate 23, integration between the elastic plate 22 and the hard plate 23 becomes firmer, and peeling off of the elastic plate 22 from the hard plate 23 is suppressed. The armature stopper 20 formed by integration between the elastic plate 22 and the hard plate 23 is directed such that the hard plate 23 is opposed to the rocking armature 7, and fitted into the attachment recess part 21 formed in the rear case 6.

Figure 3:
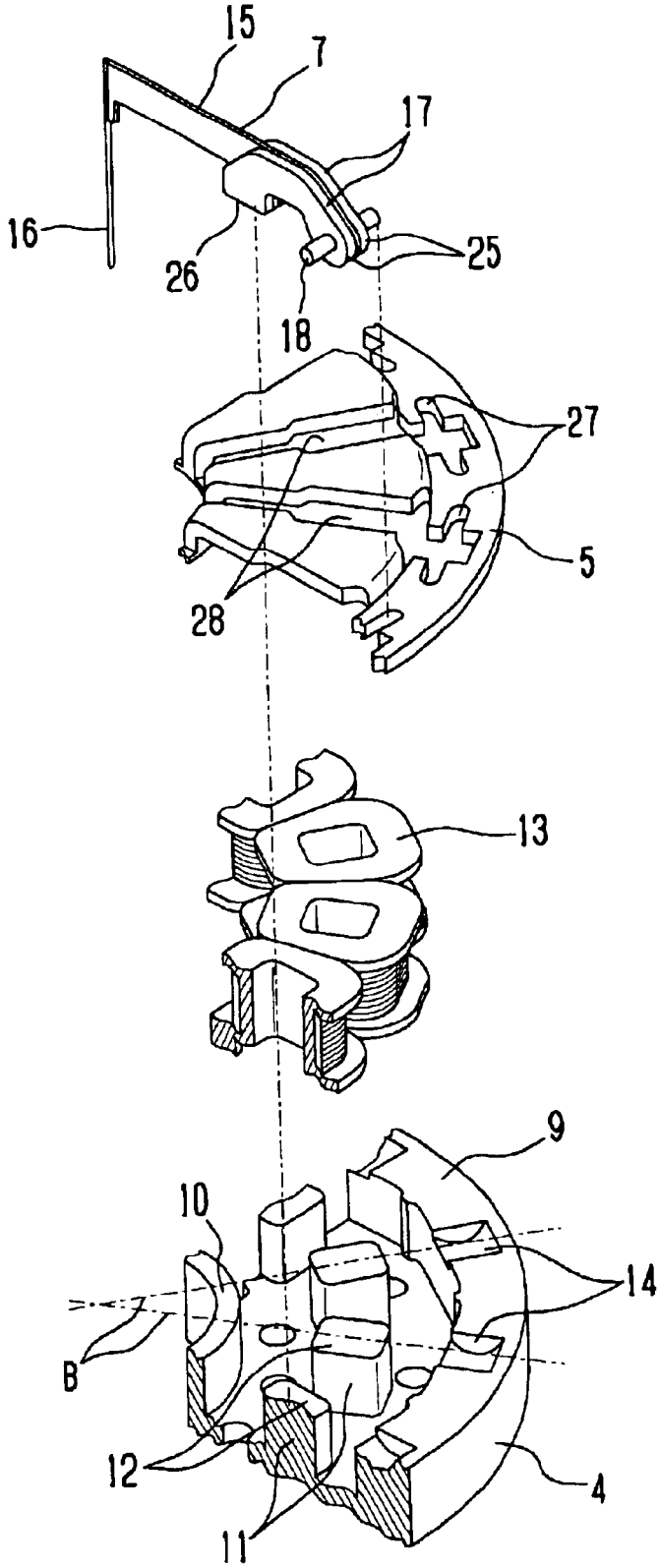
FIG. 3 is an exploded partial cut-away perspective view of a yoke and an armature spacer for explanation of the armature support structure.

Referring to FIG. 3, the detailed shapes of the yoke 4, the armature spacer 5 and the armature 7 will be described. The respective cores 11 formed in the yoke 4 are provided radially with respect to the center of the yoke 4. The cavity 14 is provided on a phantom straight line B connecting the center of the yoke 4 and the center of the magnetic pole surface 12 of the core 11. The magnetic circuit formation member 17 of the armature 7 is made of magnetic material. The magnetic circuit formation member 17 has a supported part 25 inserted into the cavity 14 formed in the yoke 4 and an attracted surface 26 attracted by the magnetic pole surface 12 of the core 11. The support shaft 18 is removably engaged in a round through hole (not shown) formed in the supported part 25 and the arm 15. The both ends of the support shaft 18 abut against both sides of the cavity 14 in the outer cylindrical part 9.

The armature spacer 5 is provided between the yoke 4 and the rear case 6 for formation of space to enable rocking of the armature 7. Plural grooves 27 in which the respective support shafts 18 are engaged and plural guide grooves 28 in which the armatures 7 are engaged are formed in the armature 5. These grooves 27 define positions of the respective support shafts 18 in contact on the yoke 4 in an axial direction and positions in a direction orthogonal to the axial direction.

As the structure of wire dot printer using the above-described wire dot printer head 1 has been already known, only the principle will be briefly described. Constituent elements of the wire dot printer other than the wire dot printer head 1 will be described without drawing. The wire dot printer head 1 is mounted on a carriage reciprocate-driven along a platen. A print sheet is conveyed by a conveyance roller to a position between the platen and the wire dot printer head 1. If pressure-sensitive color paper is used as the print sheet, the pressure-sensitive color paper receives pressure from the driven wire 16 and causes coloring thereby printing is performed. If normal paper is used as the printing sheet, the print sheet receives the pressure by the wire 16 via an ink ribbon, then ink of the ink ribbon is transferred to the normal paper, thereby printing is performed.

Upon printing operation by the wire dot printer, when energization to some coil 13 is performed, a magnetic circuit is formed among the core 11 to which the coil 13 is attached, the magnetic circuit formation member 17 of the armature 7 opposite to the core 11, and the outer cylindrical part 9 of the yoke 4, thereby the armature 7 rocks about the support shaft, and the direction of rocking is the direction in which the attracted surface 26 of the magnetic circuit formation member 17 is attracted by the magnetic pole surface 12 of the core 11. The rocking position of the armature 7 at this time is the printing position shown in FIG. 1. The rocking of the armature 7 to the printing position causes the end of the wire 16 to project to the print sheet side, thus printing is performed.

When energization to the coil 13 is stopped, the formed magnetic circuit disappears, and the armature 7 rocks about the support shaft 18 toward the standby position by a biasing force of biasing member (not shown). When the armature 7 rocks to the standby position, the arm 15 of the armature 7 collides against the hard plate 23 of the armature stopper 20. The shock upon collision increases in accordance with increase in printing speed or printing pressure. However, as the hard plate 23 is formed with surface-hardened titanium and the surface-hardened titanium has excellent abrasion resistance, even if the shock upon collision between the arm 15 and the hard plate 23 is large, the hard plate 23 is not scraped, broken or deformed. Accordingly, change of printing stroke of the armature 7 due to scrape, breakage or deformation of the hard plate 23 does not occur, and variation in printing timing and printing pressure in each wire 16 due to the change of printing stroke does not occur, thus printing quality is stabled.

Further, as the elastic plate 22 is integrated with the hard plate 23, there is no gap between the hard plate 23 and the elastic plate 22. Accordingly, the shock upon collision of the arm 15 of the armature 7 which rocked to the standby position against the hard plate 23 is efficiently absorbed by the elastic plate 22. This suppresses vibration of the hard plate 23 upon collision between the arm 15 and the hard plate 23, and prevents transmission of the vibration of the hard plate 23 to the other armatures 7. Accordingly, in the other armatures 7, variation in rocking timing and printing pressure due to transmission of the vibration of the hard plate 23 does not occur, thus the printing quality is stabled.

A second embodiment of the present invention will be described with reference to FIG. 4. Elements identical to those of the first embodiment have the same reference and explanations of the elements will be omitted.

An armature stopper 20A of the present embodiment is made of the elastic plate 22 of fluorine rubber and a hard plate 29 of precipitation-hardened SUS 631. The elastic plate 22 and the hard plate 29 are integrated with each other such that no gap occurs therebetween. The integration is made by baking or by attachment using adhesive. A fluorine resin film 30 is formed on the surface of the hard plate 28.

In the present embodiment, as the hard plate 29 is made of the precipitation-hardened SUS 631 and the precipitation-hardened SUS 631 has excellent abrasion resistance, even if the shock upon collision between the arm 15 (see the first embodiment) of the armature 7 and the hard plate 29 is increased, the hard plate 29 is not scraped, broken or deformed. Accordingly, change of printing stroke of the armature 7 due to scrape, breakage or deformation of the hard plate 29 does not occur, and variation in printing timing and printing pressure in each wire 16 due to the change of printing stroke does not occur, thus printing quality is stabled.

Further, as the elastic plate 22 is integrated with the hard plate 29, there is no gap between the hard plate 23 and the elastic plate 22. Accordingly, the shock upon collision of the arm 15 of the armature 7 which rocked to the standby position against the hard plate 29 is efficiently absorbed by the elastic plate 22. This suppresses vibration of the hard plate 29 upon collision between the arm 15 and the hard plate 29, and prevents transfer of the vibration of the hard plate 29 to the other armatures 7. Accordingly, in the other armatures 7, variation in rocking timing and printing pressure due to transmission of the vibration of the hard plate 29 does not occur, thus the printing quality is stabled.

As the fluorine resin film 30 is formed on the surface of the hard plate 29, the abrasion resistance of the hard plate 29 can be improved, and abrasion of the arm 15 that collides against the hard plate 29 can be mitigated. Further, as the fluorine resin has chemical-attack resistance and corrosion resistance, the chemical-attack resistance and corrosion resistance of the hard plate 29, where the fluorine resin film 30 is formed on the surface, can be increased.

Figure 5:
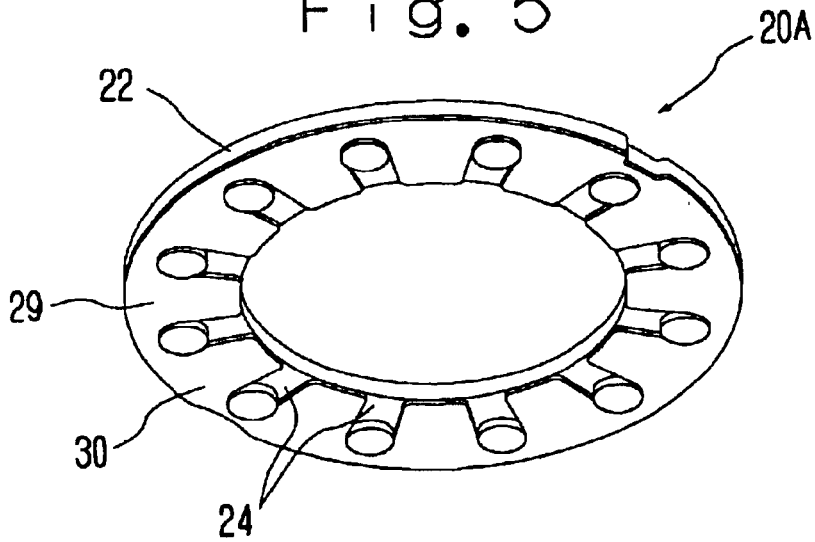
FIG. 5 is a perspective view of enlarged another armature stopper.
Figure 6:
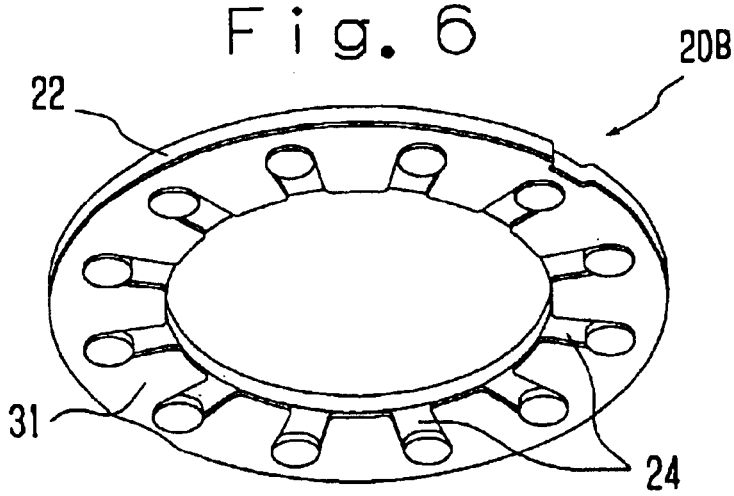
FIG. 6 is a perspective view of enlarged another armature stopper.

A third embodiment of the present invention will be described with reference to FIG. 5. Elements identical to those of the first embodiment have the same reference and explanations of the elements will be omitted.

An armature stopper 20B of the present embodiment is comprised of the elastic plate 22 of fluorine rubber and a hard plate 31 of marageing steel. The elastic plate 22 and the hard plate 31 are integrated with each other such that no gap occurs therebetween. The integration is made by baking or by attachment using adhesive.

In the present embodiment, as the hard plate 31 is made of marageing steel and the marageing steel has excellent abrasion resistance, even if the shock upon collision between the arm 15 (see the first embodiment) of the armature 7 and the hard plate 31 is increased, the hard plate 31 is not scraped, broken or deformed. Accordingly, change of printing stroke of the armature 7 due to scrape, breakage or deformation of the hard plate 31 does not occur, and variation in printing timing and printing pressure in each wire 16 due to the change of printing stroke does not occur, thus printing quality is stabled.

Further, as the elastic plate 22 is integrated with the hard plate 31, there is no gap between the hard plate 31 and the elastic plate 22. Accordingly, the shock upon collision of the arm 15 of the armature 7 which rocked to the standby position against the hard plate 31 is efficiently absorbed by the elastic plate 22. This suppresses vibration of the hard plate 31 upon collision between the arm 15 and the hard plate 31, and prevents transmission of the vibration of the hard plate 31 to the other armatures 7. Accordingly, in the other armatures 7, variation in rocking timing and printing pressure due to transmission of the vibration of the hard plate 31 does not occur, thus the printing quality is stabled.

What is claimed is:

1. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of surface-hardened titanium, the armature stopper being provided in a position and direction in which the armature, when rocking to the standby position, collides against the hard plate, wherein the elastic plate and the hard plate are integrated with each other by baking, and wherein a part of the elastic plate is caught in a cutout formed in the hard plate.

2. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of precipitation-hardened SUS 631, the armature stopper being provided in a position and direction in which the armature, when rocking to the standby position, collides against the hard plate, wherein the elastic plate and the hard plate are integrated with each other by baking, and wherein a part of the elastic plate is caught in a cutout formed in the hard plate.

3. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of surface-hardened titanium, the armature stopper being provided in a position and direction in which the armature, when rocking to the standby position, collides against the hard plate, wherein the elastic plate and the hard plate are integrated with each other by baking, and wherein a part of the elastic plate is caught in a cutout formed in the hard plate.

4. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of surface-hardened titanium, the armature stopper being provided in a position and direction in which the armature, when rocking to the standby position, collides against the hard plate, wherein the elastic plate and the hard plate are integrated with each other by attachment using adhesive, and wherein a part of the elastic plate is caught in a cutout formed in the hard plate.

5. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of precipitation-hardened SUS 631, the armature stopper being provided in a position and direction in which the armature, when rocking to the standby position, collides against the hard plate, wherein the elastic plate and the hard plate are integrated with each other by attachment using adhesive, and wherein a part of the elastic plate is caught in a cutout formed in the hard plate.

6. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of surface-hardened titanium, the armature stopper being provided in a position and direction in which the armature, when rocking to the standby position, collides against the hard plate, wherein the elastic plate and the hard plate are integrated with each other by attachment using adhesive, and wherein a part of the elastic plate is caught in a cutout formed in the hard plate.

7. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of precipitation-hardened SUS 631, the armature stopper being provided in a position and direction in which the armature, when rocking to the standby position, collides against the hard plate, wherein the elastic plate and the hard plate are integrated with each other by baking, wherein a part of the elastic plate is caught in a cutout formed in the hard plate, and wherein a fluorine resin film is formed on a surface of the hard plate.

8. A wire dot printer head, comprising:

an armature capable of rocking between a printing position and a standby position;

a printing wire fixed on one end side of the armature and sliding in accordance with rocking of the armature; and an armature stopper including an elastic plate and a hard plate integrated with each other, the hard plate being made of precipitation-hardened SUS 631, the armature stopper being provided in a position and direction in which the armature, when rocking to the standby position, collides against the hard plate, wherein the elastic plate and the hard plate are integrated with each other by attachment using adhesive, and wherein a part of the elastic plate is caught in a cutout formed in the hard plate, and wherein a fluorine resin film formed on a surface of the hard plate.

* * * * *